US008038413B2

(12) United States Patent
Gilpatrick

(10) Patent No.: US 8,038,413 B2
(45) Date of Patent: Oct. 18, 2011

(54) IDLE DOWN CONTROL FOR A PRESSURE WASHER

(75) Inventor: Richard J. Gilpatrick, Whitewater, WI (US)

(73) Assignee: Briggs and Stratton Corporation, Wauwatosa, WI (US)

( * ) Notice: Subject to any disclaimer, the term of this patent is extended or adjusted under 35 U.S.C. 154(b) by 329 days.

(21) Appl. No.: 11/729,692

(22) Filed: Mar. 29, 2007

(65) Prior Publication Data

US 2008/0014096 A1 Jan. 17, 2008

Related U.S. Application Data

(60) Provisional application No. 60/831,330, filed on Jul. 17, 2006.

(51) Int. Cl.
*F04B 49/02* (2006.01)

(52) U.S. Cl. ..... 417/34

(58) Field of Classification Search ..... 417/34, 417/20, 22, 26, 29, 30, 31, 42, 44.2, 296, 417/307, 440
See application file for complete search history.

(56) References Cited

U.S. PATENT DOCUMENTS

| | | | | | |
|---|---|---|---|---|---|
| 1,817,698 | A | * | 8/1931 | McMillan | 137/204 |
| 2,651,996 | A | | 9/1953 | Nahmens | |
| 3,103,891 | A | | 9/1963 | Fulton et al. | |
| 3,690,558 | A | | 9/1972 | Tuttle | |
| 3,885,739 | A | | 5/1975 | Tuttle | |
| 3,905,516 | A | | 9/1975 | Wisnia | |
| 3,997,282 | A | | 12/1976 | Thomas et al. | |
| 4,047,665 | A | | 9/1977 | Moynihan | |
| 4,182,354 | A | * | 1/1980 | Bergstedt | 137/10 |
| 4,238,073 | A | | 12/1980 | Liska | |
| 4,330,238 | A | | 5/1982 | Hoffman | |
| 4,492,525 | A | | 1/1985 | Bilyeu | |
| 4,589,825 | A | * | 5/1986 | Schmidt | 417/290 |
| 5,035,580 | A | | 7/1991 | Simonette | |
| 5,067,654 | A | * | 11/1991 | Paige | 239/124 |
| 5,174,723 | A | | 12/1992 | Groger et al. | |
| 5,186,142 | A | | 2/1993 | Brunelli et al. | |
| 5,244,351 | A | | 9/1993 | Arnette | |
| 5,529,460 | A | | 6/1996 | Eihusen et al. | |
| 5,848,877 | A | | 12/1998 | Dill et al. | |
| 5,902,094 | A | * | 5/1999 | Hoenisch et al. | 417/26 |
| 5,979,788 | A | | 11/1999 | Rancourt et al. | |
| 6,062,822 | A | | 5/2000 | Nathan | |
| 6,123,509 | A | * | 9/2000 | Hung | 417/44.2 |
| 6,648,603 | B2 | | 11/2003 | Dexter et al. | |
| 2004/0086389 | A1 | | 5/2004 | Conner et al. | |
| 2008/0245899 | A1 | | 10/2008 | Parris | |

* cited by examiner

*Primary Examiner* — Devon C Kramer
*Assistant Examiner* — Bryan Lettman
(74) *Attorney, Agent, or Firm* — Michael Best & Friedrich LLP

(57) ABSTRACT

An idle down controller for pressure washers is responsive to the drop in pressure at the pump outlet. The controller includes a sensor disposed in the pump outlet manifold. When the fluid is being bypassed, the manifold pressure drop is communicated to an actuator. The actuator overrides the engine governor and forces the engine throttle to the idle speed. When an operator is discharging a pressurized fluid, the actuator allows the governor to operate the engine at its normal speed.

10 Claims, 9 Drawing Sheets

IDLE DOWN CONTROL FOR A PRESSURE WASHER

CROSS-REFERENCE TO RELATED APPLICATIONS

This application claims the benefit of United States Provisional Patent Application No. 60/831,330 filed Jul. 17, 2006, the entire contents of which are hereby incorporated by reference herein.

BACKGROUND

The present invention relates to an idle down control for an engine. More particularly, the present invention relates to an idle down control for an engine that provides power for a pressure washer.

Pressure washers use high-pressure liquid, typically water, to clean surfaces such as driveways, decks, walls, and the like. Generally, the pressure washer includes an engine that provides power to a pump. The pump operates to provide high-pressure fluid to a wand or a gun that includes a trigger mechanism that is actuated by the user to discharge the high-pressure fluid. Generally, the user squeezes the trigger with one hand and supports the discharge end of the gun with the other hand during use.

During periods when high-pressure water is not required, the user releases the trigger and high-pressure water from the pump discharge is directed back to the pump intake.

SUMMARY

The invention provides an idle down control that includes a pressure sensor that detects a pressure downstream of a pump. An actuator moves in response to the detected pressure between a first position in which the engine throttle is forced to an idle position, and a second position in which the engine throttle is free to move between the idle position and a wide open position. The pressure sensor measures the pressure at the pump outlet manifold such that a drop in pressure results in movement of the actuator to the first position. The position of the sensor is such that it detects a drop in pressure when fluid is being bypassed from the pump outlet to the pump inlet.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass direct and indirect mountings, connections, supports, and couplings. Further, "connected" and "coupled" are not restricted to physical or mechanical connections or couplings.

Figure 1:
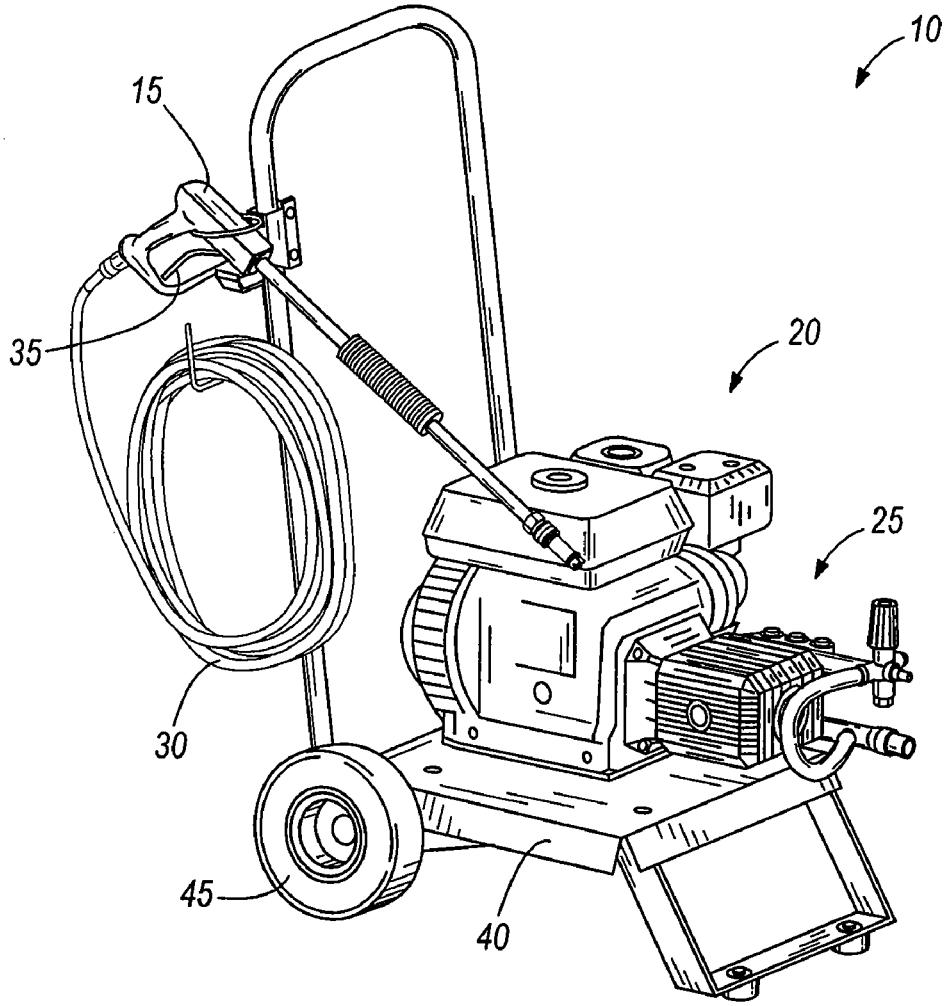
FIG. 1 is a perspective view of a pressure washer including a gun.

FIG. 1 illustrates one possible pressure washer 10 that employs the invention. As one of ordinary skill will realize, the invention described herein is suitable for use with most pressure washers that output a pressurized liquid. As such, the invention should not be limited only to pressure washers 10 similar to the one illustrated in FIG. 1. The pressure washer 10 is a mobile pressure washer that includes a trigger-actuated gun 15, an internal combustion engine 20, and a pump 25. The engine 20 drives the pump 25, which draws fluid, typically water, from a source (e.g., an onboard reservoir, a garden hose, an external tank, etc.) and selectively delivers the fluid to the gun 15, via a hose 30, under pressure.

The gun 15 includes a trigger assembly 35 that allows the user to selectively discharge a flow of water from the gun 15. Typically, the user squeezes the trigger 35 to open a valve (not shown) and begin the discharge of high-pressure fluid. When the user disengages the trigger 35, the valve closes, and high-pressure flow is inhibited from exiting the gun 15.

Figure 2:
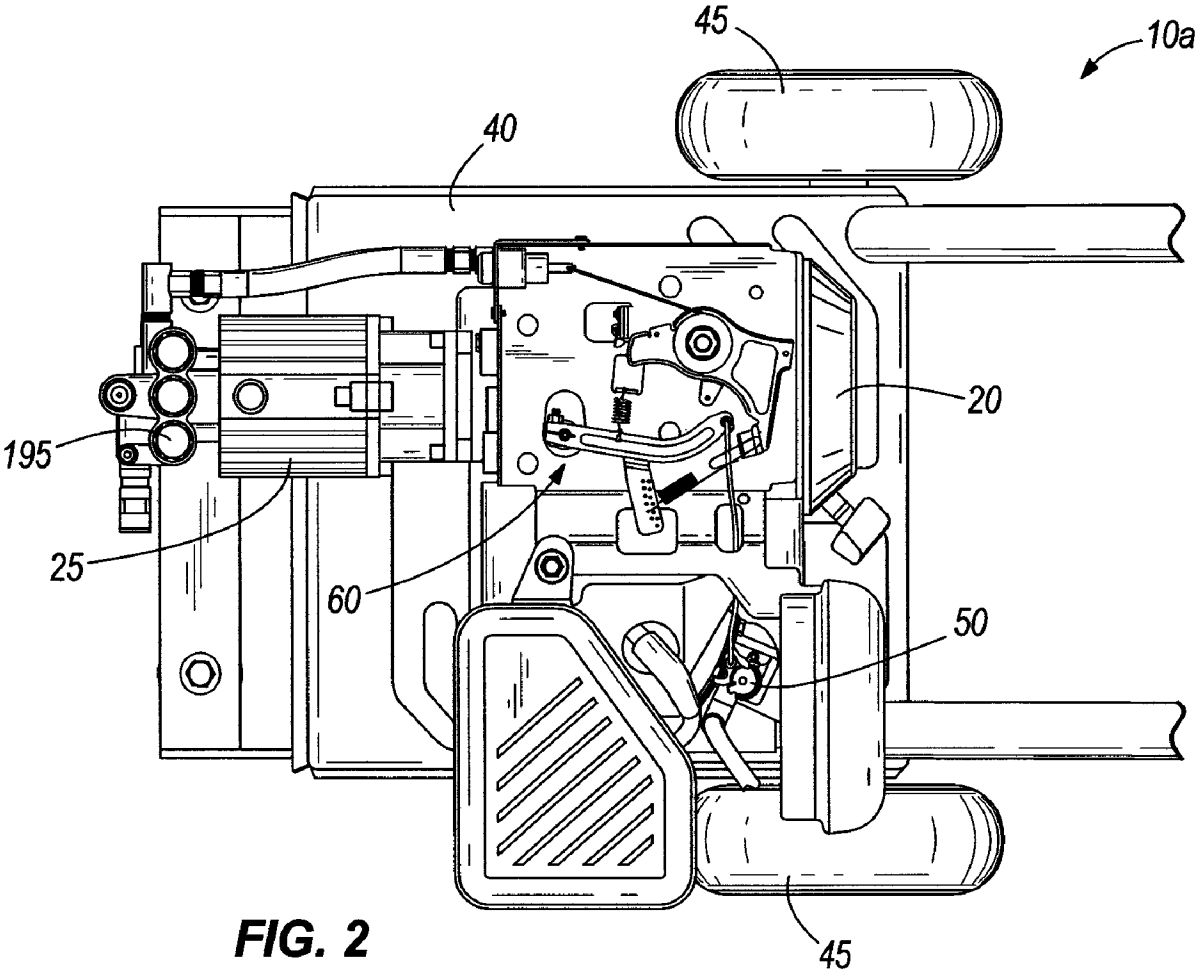
FIG. 2 is a top view of another pressure washer including an engine having a horizontal shaft, a pump, and an idle down control.

FIG. 2 illustrates a pressure washer 10*a* that includes the engine 20 supported by a frame 40 having wheels 45 to allow for movement. In the illustrated construction, a one-cylinder horizontal shaft internal combustion engine is employed. Of course, other arrangements may employ a vertical shaft engine and/or a multi-cylinder engine if desired. In addition, other engine types (e.g., diesel, rotary, etc.) could also be employed.

Figure 3:
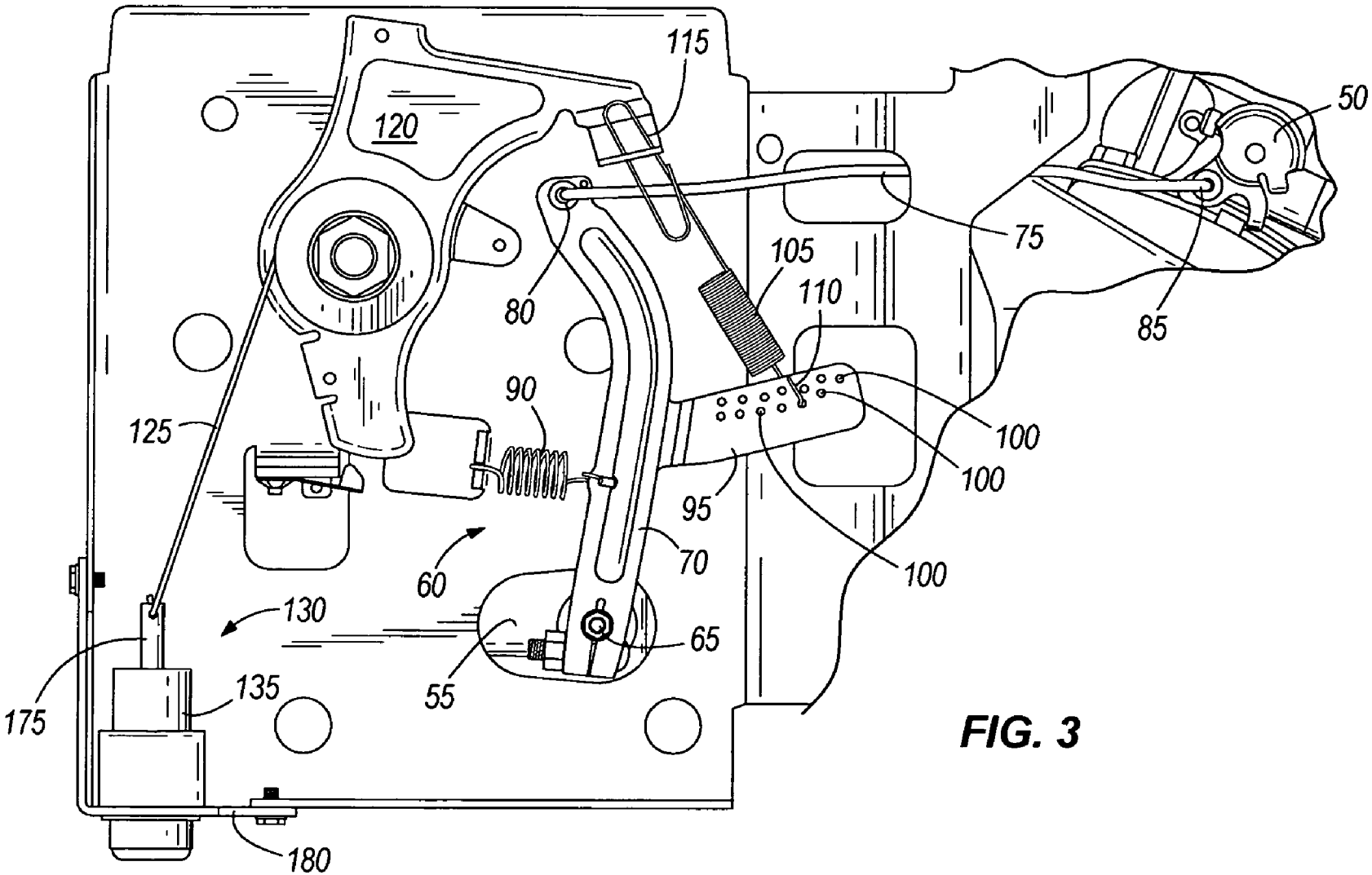
FIG. 3 is a top view of a portion of the engine of FIG. 2.

With reference to FIG. 3, the engine 20 includes a throttle 50 that is movable between an idle position and a wide open position to vary the flow of fuel and air to the engine 20. When the throttle 50 is in the idle position the engine 20 operates at an idle speed, and when the throttle 50 is in the wide open position the engine 20 operates at a desired engine speed.

The engine 20 also includes a crankcase 55, a piston (not shown), a crankshaft (not shown), and one or more cam shafts (not shown). The crankshaft rotates in response to reciprocation of the piston to produce usable shaft power. The cam shaft or shafts are coupled to the crankshaft such that they rotate at one-half the crankshaft speed to actuate intake and exhaust valves for the engine 20, as is well known in the art.

A governor 60 is coupled to the throttle 50 to control the throttle position to maintain the engine 20 at the desired engine speed during operation. The governor 60 includes a speed sensor (not shown) that senses the actual operating speed of the engine 20. If a typical mechanical governor is used, flyweights rotate in response to the rotation of the engine crankshaft or cam shaft such that the flyweights rotate at the engine speed, or one-half the engine speed (the cam shaft speed). In the illustrated construction, the speed sensor engages a governor shaft 65 that extends out of the crankcase 55 and engages a governor arm 70. The governor arm 70 moves through an arc in response to changes in speed of the engine 20.

A link arm 75 includes a first end 80 that connects to the governor arm 70 and a second end 85 that is coupled to the throttle 50. Thus, movement of the governor arm 70 produces a corresponding movement of the throttle 50. A governor spring 90 is connected to the engine 20 and to the governor arm 70 to bias the arm 70 toward a first or wide open throttle direction.

The governor arm 70 includes an extension 95 that defines a plurality of apertures 100. A second spring 105 includes a first end 110 that is coupled to the extension 95 using one of the apertures 100, and a second end 115 coupled to an idle control lever 120. The spring 105 can be connected to any one of the apertures 100 to adjust the effect of the spring 105.

The idle control lever 120 is pivotally coupled to the engine 20 such that it rotates substantially freely about an axis. An idle lever 125 is coupled to the idle control lever 120 and an idle down controller 130.

Figure 7:
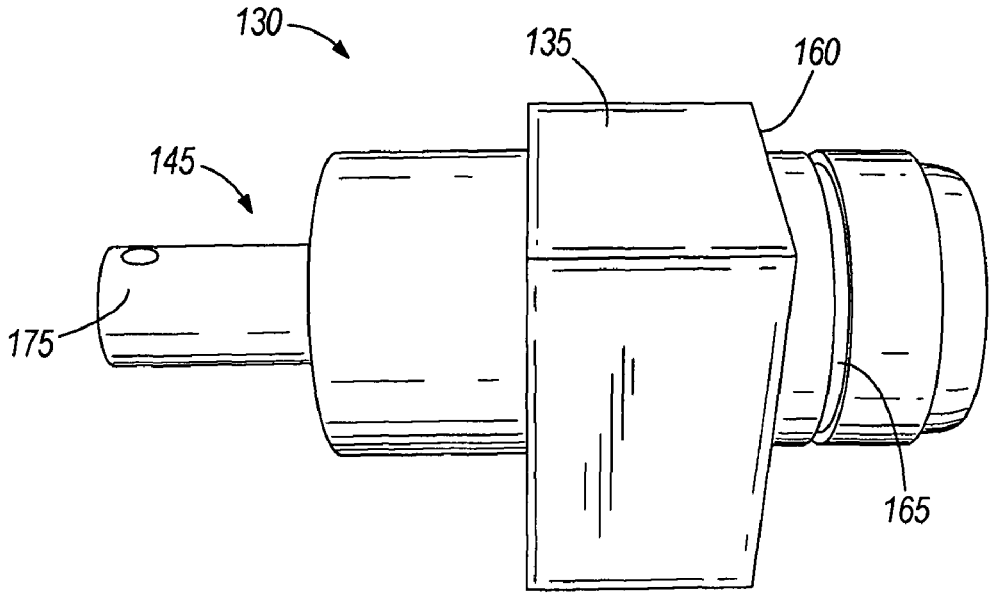
FIG. 7 is a perspective view of the idle down control of FIG. 2.
Figure 8:
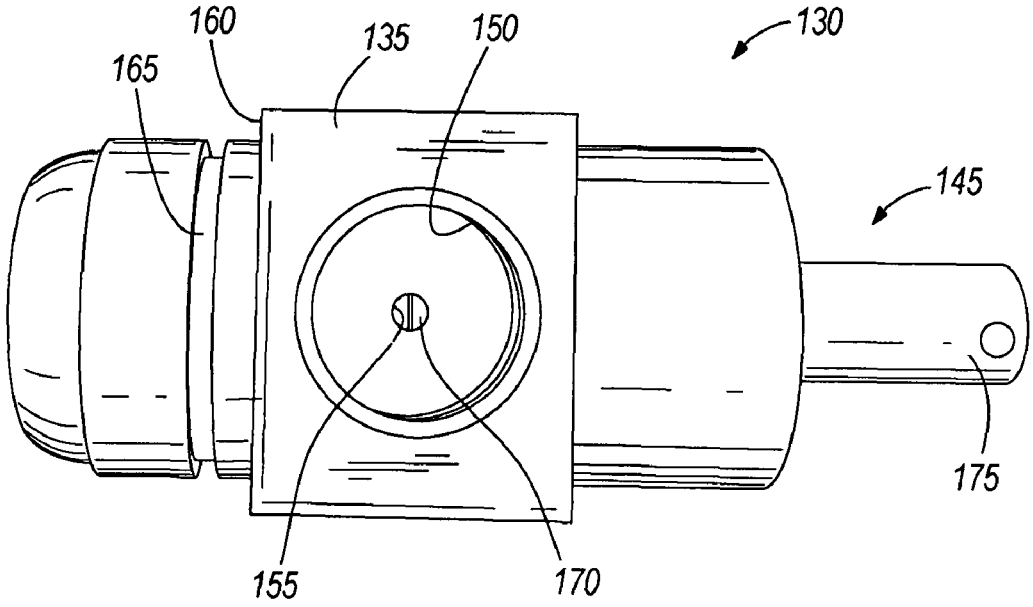
FIG. 8 is a bottom view of the idle down control of FIG. 2.
Figure 10:
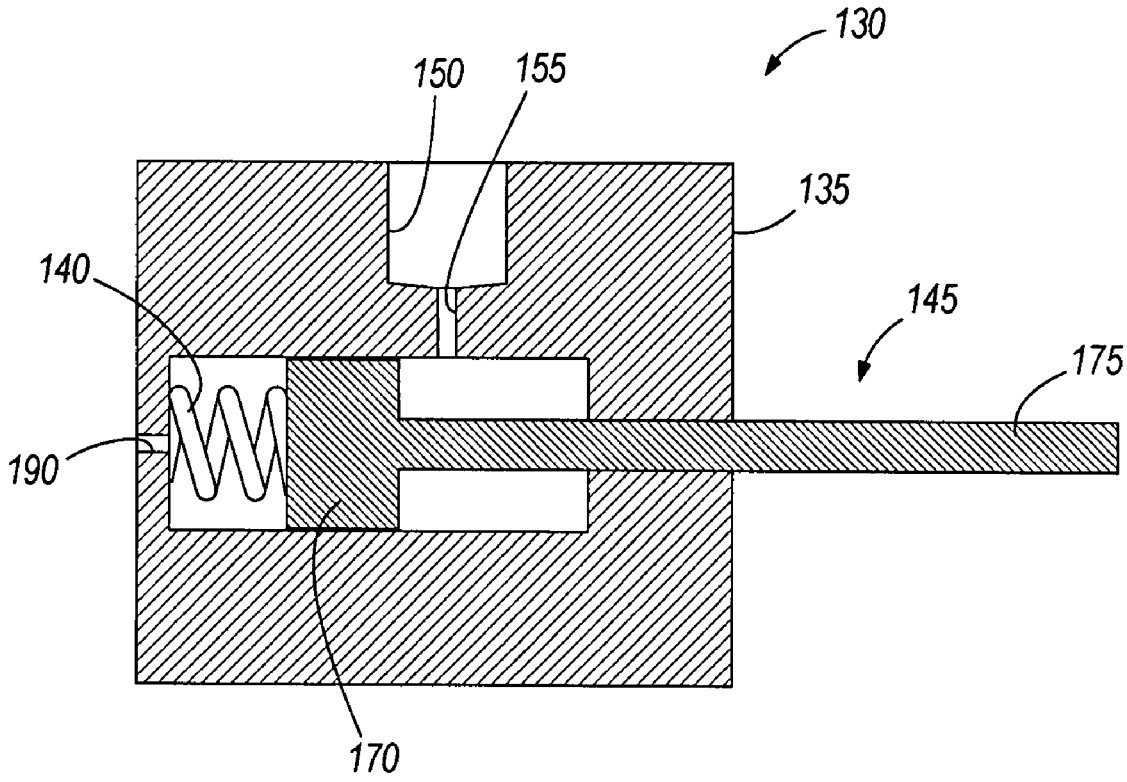
FIG. 10 is a section view of the idle down control of FIG. 2 taken along line 10-10 of FIG. 8.

With reference to FIGS. 7, 8, and 10, the idle down controller 130 includes a housing 135, a spring 140, and an actuator 145 positioned within the housing 135. In the illustrated construction, a one-piece housing 135 is employed, with other constructions employing multi-piece housings. The housing 135 includes a threaded aperture 150 (shown in FIG. 8) that provides for fluid communication to a sensor aperture 155. The sensor aperture 155 allows for the communication of the fluid pressure from the threaded aperture 150 to the actuator 145. The sensor aperture 155 is about one-quarter of an inch in diameter, with larger or smaller apertures 155 also being suitable. The relatively large size of the aperture 155 reduces the likelihood of clogging in the controller 130. The housing 135 also includes a shoulder portion 160 and a groove 165 that cooperate to attach the idle down controller 130 to the engine 20, as will be described in more detail with regard to FIG. 5.

The actuator 145 is movably supported by the housing 135 such that it can move between an idle position (shown in FIGS. 7 and 8) and a normal speed position. When the actuator 145 is in the idle position, it overrides the governor 60 and forces the throttle 50 toward the idle position. When the actuator 145 is in the normal speed position, the idle down controller 130 allows the governor 60 to control the speed of the engine 20. The actuator 145 includes a piston portion 170 and a connecting portion 175 that extends outside of the housing 135. The connecting portion 175 engages the idle lever 125 to connect the actuator 145 to the throttle 50. The piston portion 170 is in fluid communication with the sensor aperture 155 to allow the fluid pressure to act on the piston 170. The spring 140 is positioned within the housing 135 to bias the actuator 145 into the normal speed position (illustrated in FIGS. 7 and 8).

Figure 5:
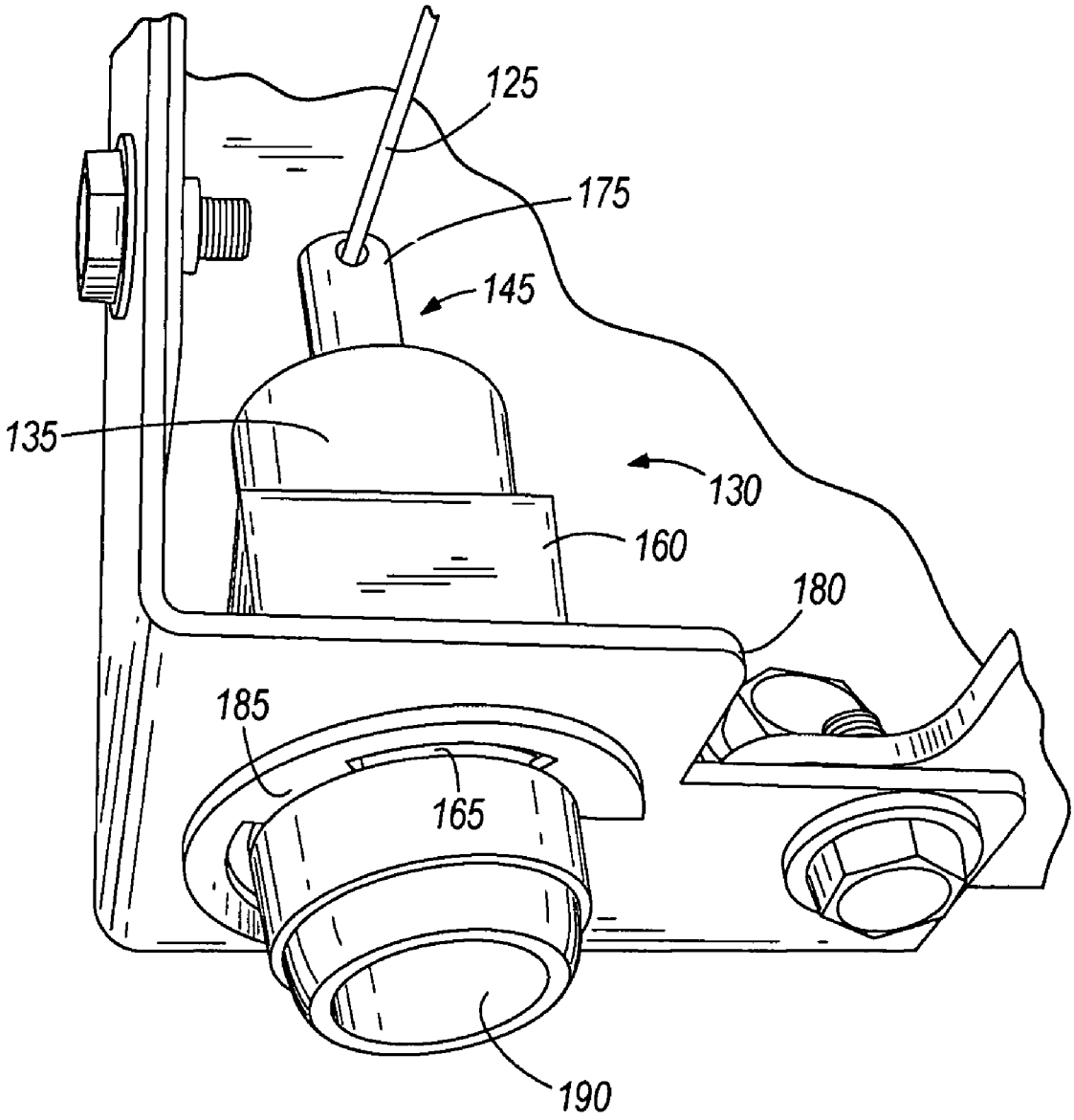
FIG. 5 is a perspective view of the idle down control of FIG. 2 on the engine of FIG. 2.

FIG. 5 illustrates the attachment of the idle down controller 130 to the engine 20. The engine 20 includes a support bracket 180 that defines an aperture sized to receive a portion of the housing 135. The shoulder portion 160 engages one side of the bracket 180 such that the groove 165 extends through the aperture. An e-ring 185 engages the groove 165 to lock the idle down controller 130 in its operating position. Also visible in FIG. 5 is a small breather aperture 190 formed in the end of the housing 135 opposite the actuator 145. The breather aperture 190 provides an air flow path into and out of the housing 135 to allow the actuator 145 to move freely.

Figure 4:
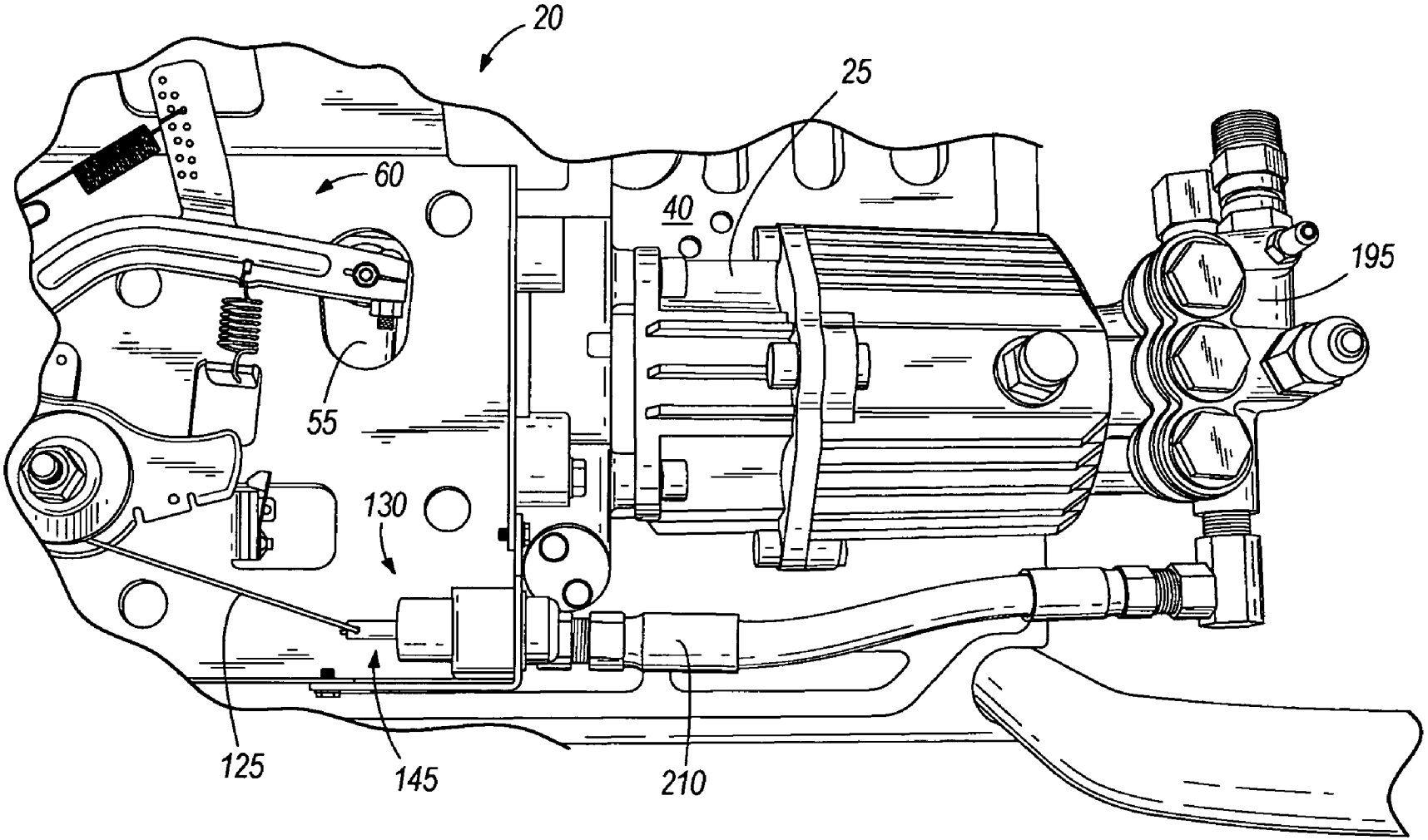
FIG. 4 is a perspective view of the pump and a portion of the engine of FIG. 2.

As shown in FIG. 4, the pump 25 is coupled to the engine 20 such that rotation of the engine 20 produces a corresponding rotation of the pump 25. In some constructions, a gearbox or other speed changing device is positioned between the engine 20 and the pump 25, with preferred constructions employing a direct connection such that the pump 25 rotates at the same speed as the engine 20. In the illustrated arrangement, a triplex pump is employed with other types of pumps 25 also being suitable for use.

Figure 9:
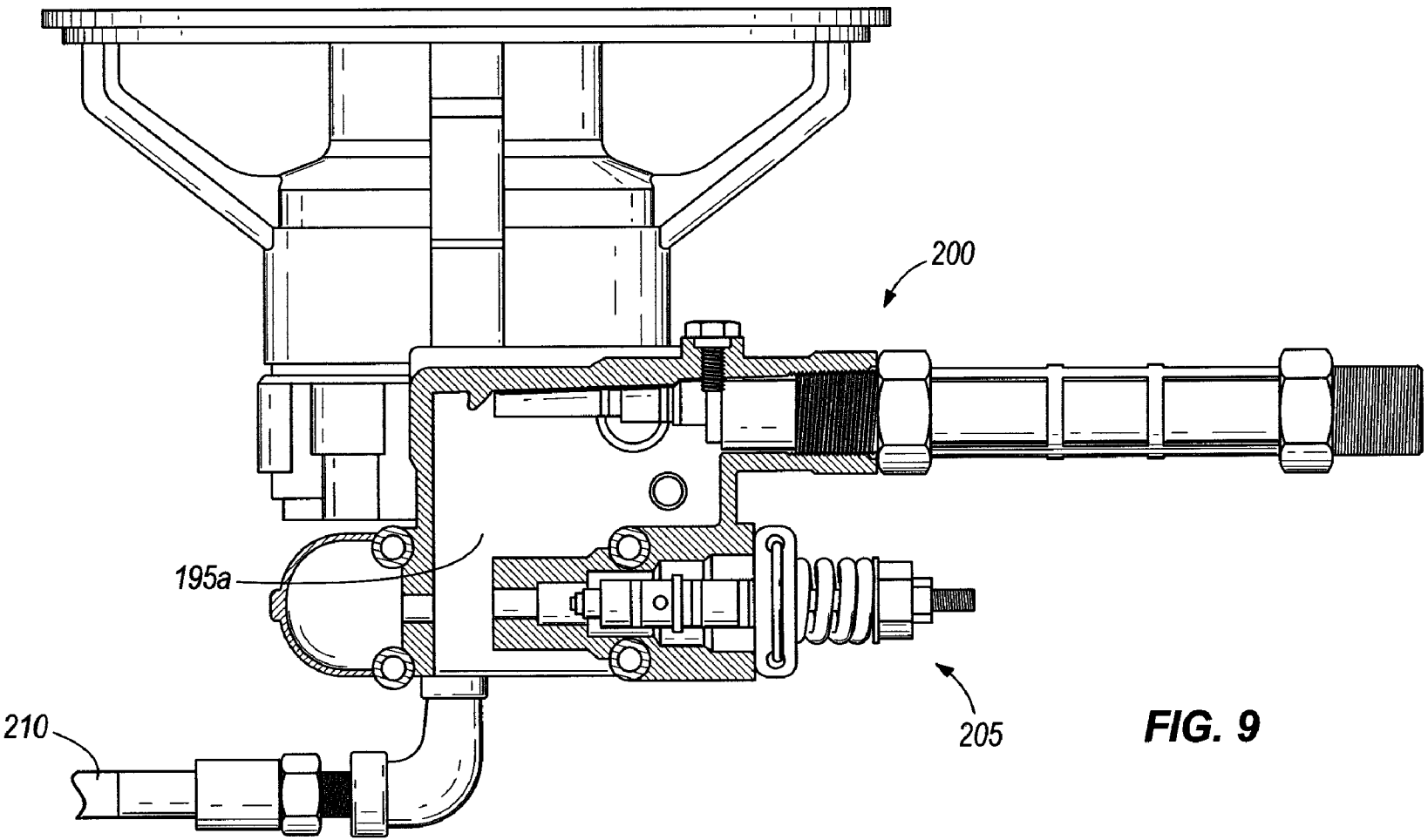
FIG. 9 is a partially broken away view of another construction of an exemplary unloader valve and regulator of the type that could be used with the present invention and that is attachable to a vertical shaft engine.

The pump 25 discharges high-pressure fluid to a manifold 195 attached to the outlet of the pump 25. The manifold 195 (manifold 195*a* in the example shown in FIG. 9) collects the fluid and directs it through an unloader valve 200 (FIG. 9) and a pressure regulator 205 before the flow passes through the hose 30 to the gun 15. Thus, the unloader valve 200 divides the flow path into an upstream side that extends from the pump to the unloader valve and a downstream side that extends from the unloader to the gun 15 or a point of use. One possible arrangement of the unloader valve 200 and pressure regulator 205 is illustrated partially broken away in FIG. 9.

Returning to FIG. 4, a pressure line 210 provides fluid communication between the manifold 195 (upstream of the unloader valve 200 and the pressure regulator 205) and the sensor aperture 155 (FIG. 8) of the idle down controller 130. Thus, the pressure applied to the piston portion 170 (FIG. 8) is substantially equal to the pressure at the manifold 195, which is substantially equal to the outlet pressure of the pump 25.

The operation of the idle down controller 130 will be described with reference to FIGS. 3 and 4. The user starts the engine 20 to begin operation of the pump 25. The pump 25 draws low-pressure fluid from the source, increases the pressure of the fluid, and delivers the fluid to the manifold 195. The user grasps the gun 15 and aims it at the surface to be cleaned, then pulls the trigger 35 to open the valve and initiate the flow of high-pressure fluid out of the gun 15. The engine 20 operates at a desired speed during the discharge of water from the gun 15 to produce a flow of high-pressure fluid that collects in the manifold 195 and then passes through the unloader valve 200 (FIG. 9) and the pressure regulator 205. The pressure regulator 205 reduces the pressure of the fluid to the desired operating pressure of the system. The manifold pressure is transferred to the sensor aperture 155 of the idle down controller 130 via the pressure line 210. Because there is no flow through the idle down controller 130, little or no flow passes through the pressure line 210. Rather, the pressure simply increases or decreases with the manifold pressure.

Figure 6:
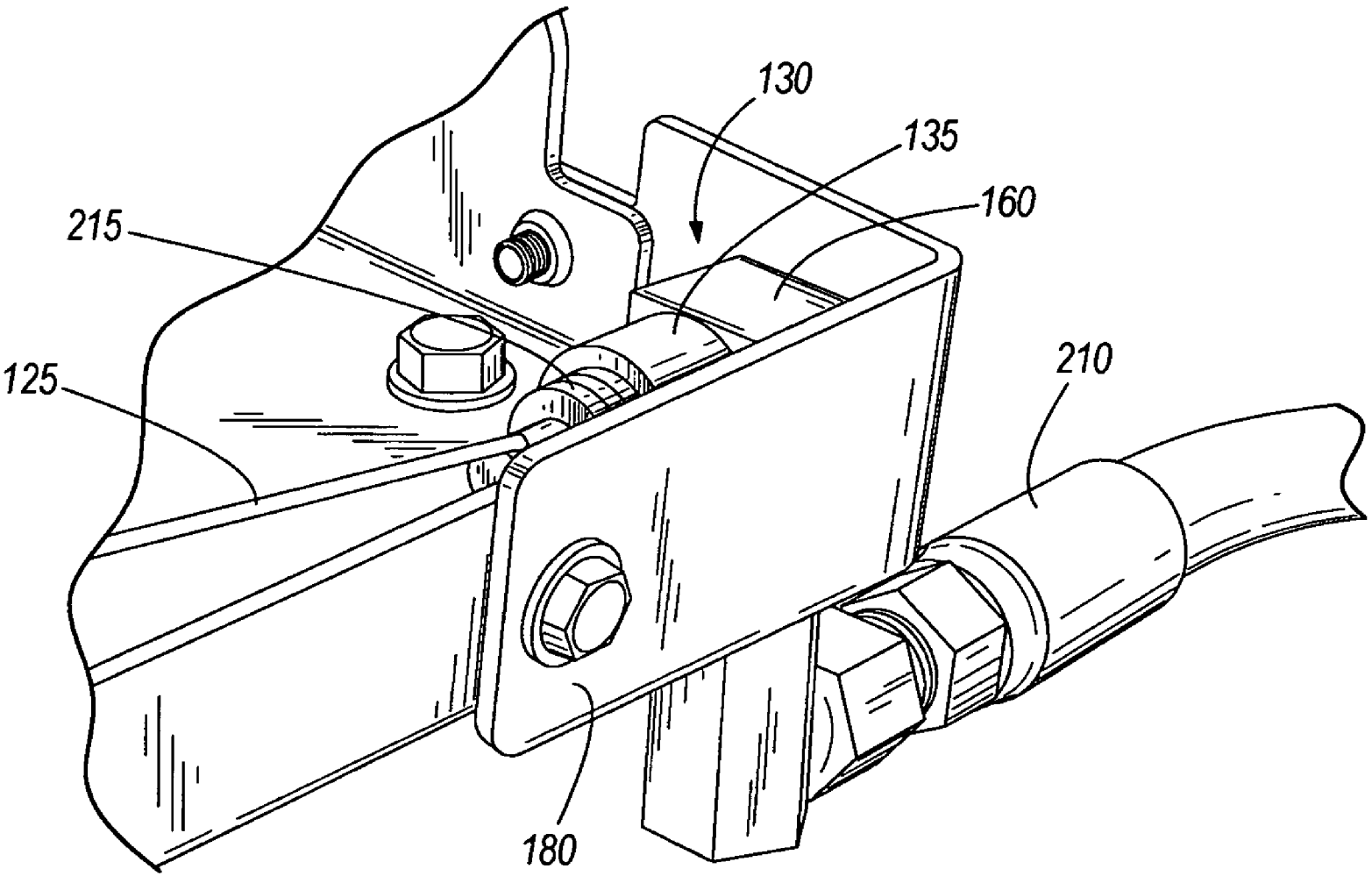
FIG. 6 is a perspective view of the idle down control of FIG. 2 on the engine of FIG. 2.

The high-pressure within the idle down controller 130 forces the actuator 145 inward against the biasing spring 140 toward the normal speed position such that the governor 60 can control the engine speed. As illustrated in FIG. 6, one or more washers 215 can be positioned between the shoulder portion 160 and the idle lever 125 to limit the travel of the actuator 145 as may be required to adjust the system.

When the user releases the trigger 35, a pressure increase occurs within the hose 30 and the gun 15 as the pumped water has no outlet. The pressure increase forces the unloader valve 200 (FIG. 9) to move from its closed position in which it directs the fluid to the gun 15 to an open position to bypass the high-pressure fluid from the outlet of the pump 25 to the inlet of the pump 25. Once the flow is bypassed, the pressure within the manifold 195, 195*a* drops substantially as the flow path for the water being pumped is much larger than the flow path through the gun 15. The pressure drop is transmitted to the sensor aperture 155 of the idle down controller 130 via the pressure line 210. The reduced fluid pressure on the system is such that the spring 140 within the housing 135 biases the actuator 145 outward to the position illustrated in FIGS. 3 and 4. In this position, the governor 60 is biased or forced toward the idle position and the engine speed is reduced to the idle speed.

The ability to reduce the engine speed when high-pressure fluid is not required reduces wear on both the engine 20 and the pump 25. In addition, reducing the engine speed can improve the fuel economy of the engine 20 in some situations.

The positioning of the idle down controller 130 results in a very simple system. The idle down controller 130 is directly coupled to the engine 20 with a single pressure line 210 between the pump 25 and the controller 130. In addition, the operation of the controller 130 is such that the controller 130 need not be overly sensitive because the difference in pressure between the high-pressure fluid (during discharge) and the low-pressure fluid (during bypass) is typically in excess of 1000 psi. For example, many types of pressure washers operate with a manifold pressure of between about 2000 psi and 4000 psi during fluid discharge. After the trigger 35 is released and the unloader valve 200 (FIG. 9) moves to the unloaded position, the manifold pressure drops substantially, for example to about 300 psi for a 2000 psi rated pressure washer. Thus, the pressure difference between the high-pressure fluid and the low-pressure fluid is about 1700 psi or greater. The large pressure difference between the two operating pressures of the system allows for the use of a less sensitive or less finely tuned idle down controller 130, thus reducing the cost of the system. The simplicity of the system further reduces the cost of manufacturing and assembling the various components.

In addition, the present device moves the engine throttle 50 to the idle position in response to a drop in pressure, rather than an increase in pressure. Thus, should the pressure line 210 develop a leak or a clog, the pressure drop would likely result in the engine 20 idling rather than operating at full speed.

It should be noted that while the foregoing describes the invention as being applied to an engine powered pressure washer, other constructions may be applied to motor driven pressure washers. In these arrangements, the idle down controller 130 actuates a device that is operable to reduce the rotational speed of the motor or stop the motor. For example, in one construction, the idle down controller 130 moves a switch that opens a circuit between the motor and the power supply to stop rotation of the motor. In other constructions, the idle down controller 130 moves a device that varies the flow of power to the motor. For example, a variable capacitor or a variable resistor could be employed. In still other constructions a frequency varying device is used to reduce the frequency of the electrical current provided to the motor, thereby slowing the motor.

Thus, the invention provides, among other things, an idle down controller 130 that responds to pressure changes within the manifold 195 to reduce the engine speed to an idle speed in response to the closure of a valve in a pressure washer gun 15.

What is claimed is:

1. A pressure washer configured to output a pressurized fluid to a point of use, the pressure washer comprising:

an engine having a throttle configured to move between an idle position that reduces the engine speed to an idle speed, and a normal speed position at which the engine runs at a speed greater than the idle speed;

a pump having an inlet, and an outlet that discharges fluid, said pump powered by said engine and configured to pressurize the fluid;

an unloader valve positioned to divide a flow path between the pump and the point of use into an upstream side that extends from the pump outlet to the unloader and a downstream side that extends from the unloader to the point of use, the unloader movable between a first position in which the discharged fluid flows to the point of use and a second position in which the discharged fluid flows to the inlet;

a manifold positioned on the upstream side of the flow path to receive the fluid discharged from the pump outlet such that a manifold pressure is substantially equal to a pump discharge pressure at all times of operation;

a pressure sensor configured to continuously detect the manifold pressure without flow passing through the sensor;

an actuator including a piston and a spring, responsive to the detected manifold pressure, configured to move between a first position when the detected manifold pressure is a low pressure, and a second position when the detected manifold pressure is a high pressure; and a linkage connected between the actuator and the throttle, configured to move the throttle to the idle position when the actuator is in the first position in response to a sensed low pressure by the pressure sensor.

2. The pressure washer of claim 1, further comprising:

a pressure line, interconnected between the manifold and the actuator, configured to communicate the manifold pressure to the actuator.

3. The pressure washer of claim 1, wherein the pressure sensor is positioned such that it detects a drop in fluid pressure when the fluid is being bypassed from the pump outlet to the pump inlet.

4. The pressure washer of claim 3, further comprising:

a gun including a trigger valve having an open and a closed position;

wherein said unloader valve causes the fluid to be bypassed when the trigger valve is in its closed position.

5. The pressure washer of claim 1, wherein said linkage includes a lever interconnected between the actuator and the throttle.

6. The pressure washer of claim 1, wherein the engine further comprises an engine speed governor, and wherein the linkage is interconnected with the governor such that linkage moves the governor to override the governor and force the throttle toward the idle position when the actuator moves to the first position.

7. The pressure washer of claim 6, wherein the governor has a control lever, and wherein the linkage is interconnected with the control lever.

8. The pressure washer of claim 6, wherein the linkage is also interconnected with the governor such that the governor is allowed to control the speed of the engine when the actuator is in its second position.

9. The pressure washer of claim 1, further comprising a pressure line that communicates the detected manifold pressure;

wherein the piston is configured to move in response to the detected manifold pressure;

and the spring biases the piston to one of the first and second positions.

10. A pressure washer configured to output a pressurized fluid to a point of use, the pressure washer comprising:

an engine having a throttle configured to move between an idle position that reduces the engine speed to an idle speed, and a normal speed position at which the engine runs at a speed greater than the idle speed;

a pump having an inlet, and an outlet that discharges fluid, said pump powered by said engine and configured to pressurize the fluid;

an unloader positioned to divide a flow path between the pump and the point of use into an upstream side that extends from the pump outlet to the unloader and a downstream side that extends from the unloader to the point of use, the unloader movable between a first position in which the discharged fluid flows to the point of use and a second position in which the discharged fluid flows to the inlet;

a manifold positioned on the upstream side of the flow path to receive the fluid discharged from the pump outlet such that a manifold pressure is substantially equal to a pump discharge pressure at all times of operation;

an actuator including one and only one piston and one and only one spring, the piston in direct and continuous fluid communication with the manifold to detect the manifold pressure, the piston configured to move between a first position when the manifold pressure is a low pressure, and a second position when the manifold pressure is a high pressure, the spring operable to bias the piston toward the first position;

a linkage connected between the actuator and the throttle, configured to move the throttle to the idle position when the actuator is in the first position in response to a sensed low pressure by the actuator.

* * * * *